United States Patent [19]

Cambre

[11] 4,308,151

[45] Dec. 29, 1981

[54] DETERGENT-COMPATIBLE FABRIC SOFTENING AND ANTISTATIC COMPOSITIONS

[75] Inventor: Cushman M. Cambre, Blue Ash, Ohio

[73] Assignee: The Procter & Gamble Company, Cincinnati, Ohio

[21] Appl. No.: 244,856

[22] Filed: Mar. 18, 1981

Related U.S. Application Data

[63] Continuation of Ser. No. 149,085, May 12, 1980, abandoned.

[51] Int. Cl.[3] ..... D06M 13/20; D06M 13/46; D06M 13/52; D06M 13/54

[52] U.S. Cl. ..... 252/8.8; 252/90; 252/102; 252/106; 252/174; 252/174.12; 252/174.13; 252/174.25; 252/179; 252/384; 252/528; 252/540; 252/547

[58] Field of Search ..... 252/8.8, 106, 102, 174.12, 252/174.13, 174.25, 179, 90, 194, 384, 528, 540, 547; 427/242

[56] References Cited

U.S. PATENT DOCUMENTS

| | | | |
|---|---|---|---|
| 3,892,681 | 7/1975 | Edwards | 252/551 |
| 3,936,537 | 2/1976 | Baskerville | 427/242 |
| 3,985,669 | 10/1976 | Krummel | 252/116 |
| 4,062,647 | 12/1977 | Storm | 8/137 |
| 4,096,072 | 6/1978 | Brock et al. | 252/8.8 |

OTHER PUBLICATIONS

Davidsohn, J., et al., Soap Manufacture, vol. I, published by Interscience Publishers, New York 1953, p. 206.

*Primary Examiner*—Dennis L. Albrecht
*Attorney, Agent, or Firm*—Robert B. Aylor; Thomas H. O'Flaherty; Richard C. Witte

[57] ABSTRACT

Detergent-compatible antistatic compositions are described containing a combination of cationic antistatic agents and hydrogenated triglycerides as discrete particles. Preferred compositions also include certain smectite clay materials to permit the simultaneous attainment of fabric softening, static-reduction and cleansing effects of fabrics washed therein.

24 Claims, No Drawings

DETERGENT-COMPATIBLE FABRIC SOFTENING AND ANTISTATIC COMPOSITIONS

CROSS REFERENCE TO RELATED CASES

This is a continuation-in-part of my copending application Ser. No. 149,085 filed May 12, 1980, now abandoned.

BACKGROUND OF THE INVENTION

This invention relates to compositions adapted to provide antistatic effects in fabric laundering operations. More particularly, it relates to the provision of these effects while simultaneously cleansing fabrics by means of conventional synthetic detergent compounds and organic or inorganic detergent builders.

Various quaternary ammonium compounds known in the art possess antistatic properties. These compounds are well known to be incompatible with anionic surfactants commonly employed in the laundering of fabrics. The opposite electrical charges of the two species lead not only to the mutual attraction of the surfactants, which results in formation of insoluble compounds and the depletion of the respective materials, but also to reversal of the electrical charges on surfaces exposed to the wash liquor. This reversal results in undesirable effects such as increased soil redeposition on fabrics and poorer soil removal. A further consequence of this incompatibility is the inhibition of the tendency of the cationic surfactant to deposit on the fabric surface and an associated reduction in the antistatic benefit delivered to the laundered fabric.

One solution to this problem is disclosed in U.S. Pat. No. 3,936,537, Baskerville et al for Detergent-Compatible Fabric Softening and Antistatic Compositions issued Feb. 3, 1976, and incorporated herein by reference. The particular dispersion inhibitor of this invention has distinct advantages over most of the dispersion inhibitors disclosed by Baskerville et al in terms of physical characteristics, especially in resistance to caking when shipped in bulk.

SUMMARY OF THE INVENTION

The present invention is based in part upon the discovery that the hydrogenated triglycerides of this invention not only protect the quaternary ammonium antistatic agents as taught by Baskerville et al, but also form more free-flowing prills than the dispersion inhibitors specifically exemplified by Baskerville et al.

A particulate detergent additive product adapted to prevent static buildup on textiles when applied thereto from a detergent wash liquor said particulate product being an intimate mixture of:

(a) 5–95% by weight of the particles of quaternary ammonium compounds of formula $[R_1R_2R_3R_4N]^+Y^-$, wherein at least one of $R_1R_2R_3$ and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y constituting an anionic radical selected from the group consisting of hydroxide, halide, acetate, sulphate, methylsulfate and phosphate ions, and (b) 5–95% by weight of the particles of a dispersion inhibitor, comprising at least about 1% of solid hydrogenated triglycerides of fatty acids having chain lengths of from about $C_{12}$ to about $C_{22}$, substantially all of the individual particles having a size within the range from about 10 microns to about 500 microns, said product having a maximum solubility in water of 50 ppm at 25° C. and having a softening point in the range from about 100° F. to about 200° F.

The present invention also encompasses, as integral formulations, compositions containing the particulate detergent additive product hereinbefore defined in combination with synthetic detergent compounds and organic or inorganic builder salts. Such compositions, when added to water, provide a laundering bath which provides simultaneous cleansing, softening, and antistatic effects.

DETAILED DESCRIPTION OF THE INVENTION

The additive product of this invention employs two essential ingredients; the quaternary ammonium antistatic agent; and the hydrogenated triglyceride dispersion inhibitor. The detergent compositions of the invention additionally comprise a water-soluble detergency compound and a detergency builder salt. The quaternary ammonium compound provides antistatic effects on the fabrics and some softening benefit to the fabrics while the detergent and builder components provide the known cleansing and detergency building effects. The various components of the compositions herein are described in greater detail hereinafter, together with the methods of preparation of the particulate detergent additive products and detergent compositions containing them.

Built laundry detergent compositions of the invention comprise (a) from about 10% to about 25% by weight of an anionic detergent surfactant or mixtures of anionic and nonionic detergent surfactants; (b) from about 10% to about 60% by weight of an organic or inorganic detergent builder salt; and (c) from about 1.5% to about 25% by weight of the composition of a particulate detergent additive product adapted to prevent static buildup on textiles when applied thereto from a detergent wash liquor, said particulate product being an intimate mixture of: (a) 95–5% by weight of the particles of quaternary ammonium compounds of formula $[R_1R_2R_3R_4N]^+Y^-$, wherein at least one of $R_1R_2R_3$ and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y consistuting an anionic radical selected from the group consisting of hydroxide, halide, acetate, sulphate, methylsulfate and phosphate ions, (b) 5–95% by weight of the particles of a dispersion inhibitor, comprising at least about 1% of solid hydrogenated triglycerides of fatty acids having chain lengths of from about 12 to about 22 carbon atoms, substantially all of the individual particles having a size within the range from about 10 microns to about 500 microns, said product having a maximum solubility in water of 50 ppm at 25° C. and having a softening point in the range from about 100° F. to about 200° F.

The detergent compositions herein provide a solution pH of from about 7 to about 12, preferably from about 9 to about 11, when dissolved in water at a concentration of about 0.12% by weight.

Antistatic Agent

The quaternary ammonium antistatic agents will normally be employed in the particulate additive products in an amount of from about 95% to about 5%, preferably from 90% to 80% by weight of the additive particles. The quaternary ammonium antistatic agent will normally be present in the detergent compositions of the invention in an amount of from about 0.5% to about 15%, preferably in an amount of from about 1% to about 10%, and most preferably in an amount of from about 2% to 5% by weight of the composition. Whether an additive or detergent composition of the invention is employed in providing an aqueous laundering bath or liquor, an amount sufficient to provide a concentration of quaternary ammonium compound in the bath or liquor of from about 5 ppm (parts per million) to about 250 ppm will normally be employed.

The antistatic agents useful herein are quaternary ammonium salts of the formula $[R_1R_2R_3R_4N]^+Y^-$ wherein $R_1$ and preferably $R_2$ represent an organic radical containing a group selected from a $C_{16}$–$C_{22}$ aliphatic radical or an alkyl phenyl or alkyl benzyl radical having 10–16 atoms in the alkyl chain, $R_3$ and $R_4$ represent hydrocarbyl groups containing from 1 to about 4 carbon atoms, or $C_2$–$C_4$ hydroxy alkyl groups and cyclic structures in which the nitrogen atom forms part of the ring, and Y is an anion such as halide or methosulfate.

In the context of the above definition, the hydrophobic moiety (i.e., the $C_{16-22}$ aliphatic, $C_{10-16}$ alkyl phenyl or alkyl benzyl radical) in the organic radical ($R_1$ and $R_2$) may be directly attached to the quaternary nitrogen atom or may be indirectly attached thereto through an amide, ester, alkoxy, ether, or like group.

The quaternary ammonium antistatic compounds useful herein include both water soluble and substantially water insoluble materials. For example, the imidazolinium compounds of the structure

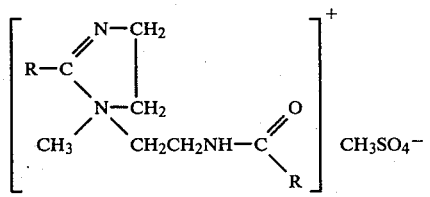

where R is a $C_{16}$–$C_{20}$ alkyl group, possess appreciable water solubility, but can be utilized in the present invention by mixture with the appropriate level and type of hydrogenated triglyceride to give an ultimate particle solubility in water of less than 50 ppm at 25° C.

Similarly other relatively water-soluble quaternary ammonium antistatic agents can be used such as the diisostearyl dimethyl ammonium chlorides disclosed in U.S. Pat. No. 3,395,100 to Fisher et al incorporated herein by reference.

However, the preferred quaternary ammonium antistatic agents useful herein are characterized by their limited solubility in water. That is to say, such quaternary salts are essentially insoluble in water, existing therein in what appears to be the mesomorphic liquid crystalline state.

The quaternary ammonium antistatic agents used in this invention can be prepared in various ways well known in the art. Many such materials are commercially available. The quaternaries are often made from alkyl halide mixtures corresponding to the mixed alkyl chain lengths in fatty acids. For example, the "di-tallow" quaternaries are made from alkyl halides having mixed $C_{14}$–$C_{18}$ chain lengths. Such mixed di-long chain quaternaries are useful herein and are preferred from a cost standpoint.

As noted above, essentially any anionic group can be the counter-ion in the quaternary compounds used herein. The anionic groups in the quaternary compounds can be exchanged, one for another, using standard anion exchange resins. Thus, quaternary ammonium salts having any desired anion are readily available. While the nature of such anions has no effect on the compositions and processes of this invention, chloride ion is the preferred counter-ion from an availability standpoint.

The following are representative examples of substantially water-insoluble quaternary ammonium antistatic agents suitable for use in the compositions and processes of the instant invention. All of the quaternary ammonium compounds listed can be formulated with the detergent compositions herein, but the compilation of suitable quaternary compounds hereinafter is only by way of example and is not intended to be limiting of such compounds. Dioctadecyldimethylammonium chloride is an especially preferred quaternary antistatic agent for use herein by virtue of its high antistatic activity; ditallow dimethyl ammonium chloride is equally preferred because of its ready availability and its good antistatic activity; other useful di-long chain quaternary compounds are dicetyldimethylammonium chloride; bisdocosyldimethylammonium chloride; didocecyldimethylammonium chloride; ditallowdimethylammonium bromide; dioleoyldimethylammonium hydroxide; ditallowdiethylammonium chloride; ditallowdipropylammonium bromide; ditallowdibutylammonium fluoride; cetyldecylmethylethylammonium chloride, bis[ditallowdimethylammonium]sulfate; tris-[ditallowdimethylammonium]phosphate; and the like.

Quaternary softening and antistat materials are conventionally supplied as a mixture with a solvent material such as a lower alkanol, e.g., isopropanol. This aids dispersion in aqueous media, but is disadvantageous to the present invention. Consequently, quaternary materials for use in this invention are preferably low in solvent and ideally are substantially free thereof.

It will be appreciated that the greater the water solubility of the quaternary ammonium compound, the larger will be the amount of triglyceride and/or the smaller its water solubility in order to satisfy the essential criteria of the invention. Correspondingly for a particular quaternary ammonium compound the greater the water solubility of triglyceride, the more will have to be used.

The Hydrogenated Triglyceride

The hydrogenated triglyceride comprises at least about 1%, preferably at least 10%, more preferably at least 50% of the dispersion inhibitor which is from about 5% to about 95%, preferably from about 10% to about 20% by weight of the particulate additive product. Normally, in either the additive or detergent embodiments of the invention, an amount of triglyceride sufficient to provide a weight ratio of quaternary ammonium compound to triglyceride of from about 20:1 to about 2:1, and preferably from about 5:1 to 10:1, is employed.

The triglyceride, even in very small amounts, modifies the physical characteristics of the particulate additive product making it more free-flowing, and less sticky. The triglyceride is believed to operate by inhibiting moisture penetration into the particulate additive product.

Preferred herein because of ready availability is hydrogenated tallow, but useful triglycerides include those containing saturated fatty acids having 12 to 22 carbon atoms in the alkyl chain such as: lauric acid, myristic acid, palmitic acid, stearic acid, arachidic acid, and behenic acid, as well as mixtures of these. Particularly preferred triglycerides are those derived from naturally occurring sources such as tallow, coconut, and marine oils.

The remainder of the dispersion inhibitor, if any, is selected from the other inhibitors of U.S. Pat. No. 3,936,537, incorporated herein by reference.

Particulate Additive Product

The particulate additive product comprises a mixture of the quaternary ammonium antistatic agent and the inhibitor in a weight ratio of from about 20:1 to about 1:20, the individual particle sizes of the product lying in the range from about 10 microns to about 500 microns, preferably from about 25 microns to about 250 microns, and most preferably from about 50 microns to about 100 microns. Further essential requirements are that the particulate product should not have a solubility in water at 25° C. of greater than about 50 ppm, preferably less than about 10 ppm and that the softening or melting point of the product should lie in the range from about 100° F. to about 200° F., preferably from about 150° F. to about 175° F. The dispersion inhibitor, and consequently the particulate additive product, is preferably completely, or at least essentially, free of triglycerides of hydroxy fatty acids and especially essentially, or completely, free of hydrogenated castor oil.

These particular particulate additives are more free flowing because of the triglyceride and continue to provide protection for the antistatic agent as taught by Baskerville et al.

The particulate detergent additive product is made by intimately mixing the quaternary antistat and the inhibitor including the essential triglyceride inhibitor and then forming this mixture into particulates. This can be accomplished by dry mix addition followed by a mechanical process such as extrusion or milling to form the particulates. However, a preferred technique involves comelting of the two materials prior to the particle formation.

In at least the preferred embodiments of the present invention, comelting permits the formation, when the mixture is subsequently cooled, of a solid phase which is crystallographically distinct from either of the individual components. This phase is believed to enhance the inhibition of the solubility of the quaternary-antistat/triglyceride particle, even when the latter has a size in the range of 10 microns to 50 microns.

The formation of the particulates from the comelt can be carried out in a number of ways. The mixture can be sprayed via a single- or two-fluid pressure nozzle to form droplets of the desired size range, i.e., 50 microns to 250 microns which are then solidified by cooling and subjected to screening to remove material which is either too coarse or too fine. A tower-prilling technique can also be used to obtain the same result, namely a mixture of substantially spherical droplets having a broad spread of particle sizes about a given mean.

Alternatively a prilling process such as that disclosed in German D.O.S. Nos. 2,137,042 and 2,137,043 (both incorporated herein by reference) can be employed. Particulates made in this manner are entirely satisfactory for the purpose of delivering an antistatic benefit in accordance with the invention. However, such particulates are less satisfactory from an aesthetic standpoint in that they are visible as a deposit on fabrics which have been removed from the wash liquor, but have not been subjected to machine drying. The use of elevated drying temperatures together with the tumbling effect created by the rotary motion of the dryer, serves to soften the particulates and spread them over the fabrics to give the desired antistat benefit and eliminate their aesthetic disadvantage.

Another method of obtaining particulates of the desired size range which are not visible to the naked eye on fabrics removed from the wash solution is as follows. The comelt of quaternary ammonium compound and dispersion inhibitor is solidified and then comminuted to obtain particles which are irregular and angular rather than uniform and spherical in shape. High energy comminution processes such as hammer, rod, and ball mills and air impact mills can be used but preferably a low energy input process is employed which does not result in an appreciable temperature increase of the material being treated. While the theory of the process is not fully understood, it is believed that a low energy comminution process such as grating through a sieve avoids the surface softening or melting associated with processes involving higher energy inputs and thereby minimizes agglomeration of the comminuted material. Any agglomerates which do form are fragile in nature and disintegrate under the subsequent agitated conditions of the wash into individual particles of the desired size range.

The particulate detergent additive product is preferably formed into an agglomerate according to the teachings of U.S. Pat. No. 4,141,841, McDanald, issued Feb. 27, 1979, and incorporated herein by reference.

Detergent Compositions

The particulate detergent additive products of the present invention or their agglomerates according to the teachings of McDanald, may themselves constitute components of laundry detergent compositions of different types, e.g., additive products intended to provide specific performance attributes where added to wash liquors containing conventional detergent formulations or fully developed formulations designed to include the particulate additive as part of the product.

Examples of the first type include mixtures of the particulate additive with other granular materials such as oxygen or chlorine bleaches, peroxy bleach activators, optical brighteners, enzymatic agents, detergent builders, and sequestering agents, antibacterial agents, fabric softeners, and the like. In this type, the percentage by weight of the particulate additive product can vary between very wide limits depending on the number and amount of the other components, but will generally lie within the range of 5% to 95%, preferably 10% to 50% by weight of the composition.

Examples of the second type are those compositions comprising surfactants, detergent builders, suds modifiers, antiredeposition agents, bleaches, etc., which constitute complete heavy-duty laundry products.

In fully developed detergent compositions the particulate detergent additive product will normally be present in an amount sufficient to provide from about 1% to about 10%, preferably from about 2% to about 5% of the quaternary antistat material in the detergent composition. The remainder of the composition will comprise from about 1% to about 50% by weight, preferably 10% to 25% by weight of a detergent surfactant and from approximately 15% to about 60%, more preferably 20% to 45% by weight of a detergent builder, together with other conventional detergent ingredients.

Surfactant

From about 1% to about 50% by weight, preferably about 10% to about 25% by weight and most preferably from about 5% to about 20% by weight, of the detergent compositions can comprise an organic surfactant selected from the group consisting of anionic, nonionic, ampholytic, and switterionic detergents and mixtures thereof. Examples of organic surfactants of these types are described in U.S. Pat. No. 3,579,454; incorporated herein by reference, column 11, line 45 to column 13, line 64.

Water-soluble salts of the higher fatty acids, i.e., "soaps" are useful as the anionic surfactant herein. This class of surfactants includes ordinary alkali metal soaps such as the sodium, potassium, ammonium, and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present invention are the sodium and potassium alkyl sulfates, especially those obtained by sulfating the higher alcohols ($C_8C_{18}$ carbon atoms) produced by reducing the glycerides of tallow or coconut oil; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099 and 2,477,383, incorporated herein by reference (especially valuable are linear straight chain alkyl benzene sulfonates in which the average of the alkyl groups is about 11.8 carbon atoms and commonly abbreviated as $C_{11.8}$LAS).

Other detergents for use herein are alkyl ether sulfates although, in general, their use should be minimized. These materials have the formula $RO(C_2H_4O)_x$-$SO_3M$ wherein R is alkyl or alkenyl of about 10 to about 20 carbon atoms, x is 1 to 30, and M is a water-soluble cation such as alkali metal, ammonium, and substituted ammonium. The alkyl ether sulfates useful in the present invention are condensation products of ethylene oxide and monohydric alcohols having about 10 to about 20 carbon atoms. Preferably, R has 14 to 18 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 30 and especially 1 to 6, molar proportions of ethylene oxide and the resulting mixture of molecular species, having for example, an average of 3 moles of ethylene oxide per mole of alcohol, is sulfated and neutralized.

Specific examples of fat-derived alkyl polyether sulfates of the present invention are sodium coconut alkyl oxyethylene ether sulfate; sodium tallow alkyl trioxyethylene ether sulfate; and sodium tallow alkyl hexaoxyethylene sulfate.

Examples of alkyl ether sulfates of synthetic origin in which the starting alcohol is a narrow-cut olefin feed stock include sodium $C_{14-15}$ alkyl trioxyethylene ether sulfate and $C_{15-16}$ alkyl trioxyethylene ether sulfate.

Other anionic surfactant compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain from about 8 to about 12 carbon atoms.

Other useful anionic surfactants herein include the water-soluble salts of esters of alpha-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkene sulfonates containing from about 10 to 20 carbon atoms in the alkane group; and $\beta$-alkyloxy alkane sulfonates containing from about 1 to 3 carbon atoms in the alkyl group and from about 8 to 20 carbon atoms in the alkane moiety.

Other preferred detergents utilizable herein are olefin sulfonates having about 12 to about 24 carbon atoms. The term "olefin sulfonates" is used herein to mean compounds which can be produced by the sulfonation of alpha-olefins by means of uncomplexed sulfur trioxide, followed by neutralization of the acid reaction mixture in conditions such that any sulfones which have been formed in the reaction are hydrolyzed to give the corresponding hydroxy-alkane sulfonates. The sulfur trioxide can be liquid or gaseous, and is usually, but not necessarily, diluted by inert diluents, for example by liquid $SO_2$, chlorinated hydrocarbons, etc., when used in the liquid form, or by air, nitrogen, gaseous $SO_2$, etc., when used in the gaseous form.

The alpha-olefins from which the olefin sulfonates are derived are mono-olefins having 12 to 24 carbon atoms, preferably 14 to 16 carbon atoms. Preferably they are straight chain olefins. Examples of suitable 1-olefins include 1-dodecane, 1-tetradecene, 1-hexadecene, 1-octadecene, 1-eicosene, and 1-tetraconsene.

In addition to the true alkene sulfonates and a portion of hydroxy-alkane sulfonates, the olefin sulfonates can contain minor amounts of other materials, such as alkene disulfonates depending upon the reaction conditions, proportion of reactants, the nature of the starting olefins and impurities in the olefin stock and side reactions during the sulfonation process.

A specific anionic detergent which is useful in the present invention is described more fully in the U.S. Pat. No. 3,332,880 of Phillip F. Pflaumer and Adrian Kessler, issued July 25, 1967, titled "Detergent Composition", the disclosure of which is incorporated herein by reference.

Preferred nonionic surfactants useful in the present invention are those obtained by the condensation of one to twelve ethylene oxide moieties with a $C_{10}$–$C_{18}$ aliphatic alcohol. The alcohol may be completely linear as occurs in materials derived from natural feedstocks such as vegetable oils and animal fats, or may be slightly branched as occurs in petroleum-derived alcohols made by oxo-type synthesis. Particularly preferred materials are $C_{14}$–$C_{15}$ alcohol condensed with an average of seven ethylene oxide groups, $C_{12}$–$C_{13}$ alcohol condensed with an average of about four ethylene oxide groups and then subjected to stripping to remove unethoxylated and low ethoxylated materials, to leave an ethoxylate having a means of 4.5 ethylene oxide groups.

Preferred zwitterionic materials are derivatives of quaternary ammonium compounds containing an aliphatic straight chain group of 14–18 carbon atoms and a sulfate or sulfonate anionic solubilizing group. Specific examples include 3-(N,N-dimethyl-N-hexadecyl ammonio-2-hydroxypropane-1-sulfonate; 3-(N,N-dimethyl-N-tallowyl ammonio)-2-hydroxypropane-1-sulfonate; 3-(N,N-dimethyl-N-tetradecyl ammonio)propane-1-sulfonate; and 6-(N,N-dimethyl-N-hexadecylammonio)hexanoate.

Detergency Builders

The detergent compositions of the instant invention can also contain a detergent builder in an amount from about 5% to 95% by weight, preferably from about 15% to 60% by weight of the composition. Useful builders herein include any of the conventional inorganic and organic water-soluble builder salts as well as various water-insoluble and so-called "seeded" builders. In the present compositions these water-soluble builder salts serve to maintain the pH of the laundry solution in the range of from about 7 to about 12, preferably from about 8 to about 11. Furthermore, these builder salts enhance the fabric cleaning performance of the overall compositions while at the same time they serve to suspend particulate soil released from the surface of the fabrics and prevent its redeposition on the fabric surfaces. Additionally, in preferred detergent compositions that contain certain smectite clays as fabric softening agents, polyanionic builder salts have been found to cause these smectite-type clays to be readily and homogeneously dispersed throughout the aqueous laundering medium with a minimum of agitation. The homogeneity of the clay dispersion is necessary for the clay to function effectively as a fabric softener, while the ready dispersability allows granular detergent compositions to be formulated.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, polyphosphates, tripolyphosphates, bicarbonates, silicates, and sulfates. Specific examples of such salts include the sodium and potassium tetraborates, bicarbonates, carbonates, tripolyphosphates, pyrophosphates, and hexametaphosphates.

Examples of suitable organic alkaline detergency builder salts are: (1) water-soluble amino polyacetates, e.g., sodium and potassium ethylenediaminetetraacetates, nitrilotriacetates, and N-(2-hydroxyethyl)nitrilodiacetates; (2) water-soluble salts of phytic acid, e.g., sodium and potassium phytates; (3) water-soluble polyphosphonates, including, sodium, potassium and lithium salts of ethane-1-hydroxy-1,1-diphosphonic acid; sodium, potassium, and lithium salts of methylenediphosphonic acid and the like.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference are also suitable herein. It is to be understood that while the alkali metal salts of the foregoing inorganic and organic polyvalent anionic builder salts are preferred for use herein from an economic standpoint, the ammonium, alkanolammonium, e.g., triethanolammonium, diethanolammonium, and the like, water-soluble salts of any of the foregoing builder anions are useful herein.

Mixtures of organic and/or inorganic builders can be used herein. One such mixture of builders is disclosed in Canadian Pat. No. 755,038, e.g., a ternary mixture of sodium tripolyphosphate, trisodium nitrilotriacetate, and trisodium ethane-1-hydroxy-1,1-diphosphonate.

A further class of builder is the insoluble aluminosilicate type which functions by cation exchange to remove polyvalent mineral hardness and heavy metal ions from solution. Preferred builders of this type have the formulation $Na_z(AlO_2)_z(SiO_2)_y.x\ H_2O$ wherein z and y are integers of at least 6, the molar ratio of z to y is in the range from 1.0 to about 0.5 and x is an integer from about 15 to about 264. Compositions incorporating builder salts of this type and builders of this type are disclosed in U.S. Pat. No. 3,985,669, Krummel et al, issued Oct. 12, 1976 and incorporated herein by reference.

Another type of detergency builder material useful in the present compositions and processes comprises a water-soluble material capable of forming a water-insoluble reaction product with water hardness cations in combination with a crystallization seed which is capable of providing growth sites for said reaction product. Such "seeded builder" compositions are disclosed in U.S. Pat. No. 4,174,291, Benjamin, issued Nov. 13, 1979 and incorporated herein by reference.

Clay Compounds

A valuable optional ingredient of the present compositions consists of particular smectite clay materials, namely sodium and calcium montmorillonites, sodium saponites, and sodium hectorites. These smectite clays are present in the additive compositions of this invention at levels from about 5% to about 90%, preferably from 8% to 75% by weight. In the built detergent composition embodiments of this invention, smectite clay is used in an amount from about 1% to about 50%, preferably from about 5% to about 25% by weight. The clays used herein are "impalpable", i.e., have a particle size which cannot be perceived tactilely. Impalpable clays have particle sizes below about 50 microns; the clays used herein have a particle size range of from about 5 microns to about 50 microns.

A more complete disclosure of the clays can be found in U.S. Pat. No. 4,062,647, Storm et al, issued Dec. 13, 1977 and incorporated herein by reference.

Specific non-limiting examples of such fabric softening smectite clay minerals are:

Sodium Montmorillonite

Brock
Volclay BC
Gelwhite GP
Thixo-Jel #1
Ben-A-Gel

Sodium Hectorite

Veegum F
Laponite SP

Sodium Saponite

Barasym NAS 100

Calcium Montmorillonite

Soft Clark
Gelwhite L

Lithium Hectorite

Barasym LIH 200

Smectite clays useful herein can be characterized as montmorillonite, hectorite, and saponite clay minerals having an ion exchange capacity of at least about 50 meq/100 g. and preferably at least 60 meq/100 g.

Most of the smectite clays useful in the compositions herein are commercially available under various tradenames, for example, Thixo-Jel #1 and Gelwhite GP from Georgia Kaolin Co., Elizabeth, N.J.; Volclay BC and Volclay #325, from American Colloid Co., Skokie, Ill.; and Veegum F, from R. T. Vanderbilt. It is to be recognized that such smectite minerals obtained under the foregoing tradenames can comprise mixtures of the various discrete mineral entitites. Such mixtures of the smectite minerals are suitable for use herein.

Within the classes of montmorillonite, hectorite, and saponite clay minerals having a cation exchange capacity of at least about 50 meq/100 g, certain clays are preferred for fabric softening purposes. For example, Gelwhite GP is an extremely white form of smectite clay and is therefore preferred when formulating white granular detergent compositions. Volclay BC, which is a smectite clay mineral containing at least 3% of iron (expressed as $Fe_2O_3$) in the crystal lattice, and which has a very high ion exchange capacity, is one of the most efficient and effective clays for use in laundry compositions and is preferred from the standpoint of product performance. On the other hand, certain smectite clays marketed under the name "bentonite" are sufficiently contaminated by other silicate minerals, as evidenced by a low colloid content (~50%) that their ion exchange capacity falls below the requisite range, and such clays are of no use in the instant compositions.

Appropriate clay minerals for use herein can be selected by virtue of the fact that smectites exhibit a true 14 Å x-ray diffraction pattern. This characteristic pattern, taken in combination with exchange capacity measurements performed in the manner noted above, provides a basis for selecting particular smectite-type minerals for use in the compositions disclosed herein.

The smectite clay materials useful in the present invention are hydrophilic in nature, i.e., they display swelling characteristics in aqueous media. Conversely they do not swell in nonaqueous or predominantly nonaqueous systems, including those incorporating the smectite clay minerals described hereinbefore should restrict the nonionic content of the surfactant systme to less than 33% by weight of the total surfactant, preferably less than 25%.

Other Optional Components

Another optional ingredient that may be incorporated is an enzyme for removal of protein-based or carbohydrate-based stains. Enzymes for removing protein-based stains are proteolytic in nature such as those sold under the trade names "Alcalase" and "Esterase" by Novo Industries A/S Denmark or under the trade names "Maxatase" and "AZ Protease" by Gist-Brocades N. V. The Netherlands. These materials are normally incorporated at levels of up to 1% by weight, preferably 0.25% to 0.75% by weight, and are preferably coated or prilled with inert additives to minimize dust formation and improve storage stability. A wide range of enzyme materials and means for their incorporation into synthetic detergent granules is disclosed in U.S. Pat. No. 3,553,139 issued on Jan. 5, 1971, to McCarty, Roald, DeOude, Blomeyer, and Cracco which disclosure is hereby incorporated by reference.

A further ingredient that may be incorporated to improve product performance is a bleaching agent of the halogen or oxygen-containing type. Examples of the hypohalite bleach type include trichloro isocyanuric acid and the sodium and potassium dichloroisocyanurates and N-chloro and N-bromo alkane sulphonamides. Such materials are normally added to 0.5%–10% by weight of the finished product, preferably 1%–5% by weight.

Examples of oxygen-containing bleaches include sodium perborate, sodium percarbonate, and potassium monopersulphate that are incorporated at levels of 5–30% preferably 10–25% by weight of the final product. The inclusion of organic bleach activators such as phthalic anhydride, tetra acetyl ethylene diamine, tetra acetyl methylene diamine or tetra acetyl glycouril lead to the in situ production during the washing process of the corresponding organic peroxy acids which have enhanced low temperature bleaching performance. Activators of this type are normally used with sodium perborate, at usage levels of 5–15% by weight of the final product.

Materials to boost or modify the sudsing pattern of the compositions of the present invention may also be included. Examples of suds boosters include coconut and tallow mono-and di-alkanolamides, particularly ethanolamides and $C_{12-15}$ alkyl di-lower alkyl amine oxides. Typical suds depressors include long chain fatty acids such as those disclosed in U.S. Pat. No. 2,954,347 issued Sept. 27, 1960, to Wayne St. John and combinations of certain nonionics therewith as disclosed in U.S. Pat. No. 2,954,348 issued Sept. 27, 1960, to Eugene Schwoeppe, both disclosures being incorporated herein by reference.

Other optional ingredients in granular products include hydrotropes and anticaking additive such as salts of low alkyaryl sulphonic acids, salts of alpha-sulphosuccinic acid, and alpha-sulphobenzoic acid, and urea, normally utilized at levels of 0.5% to 5% by weight of the final product, preferably at levels of 1%–3% by weight. $C_{12}$–$C_{18}$ alkyl acid phosphates and their condensation products with ethylene oxide may also be incorporated at similar levels for control of crutcher mix viscosity. Antiredeposition agents such as carboxymethyl cellulose, hydroxyethyl cellulose, and their derivatives may also be incorporated.

Advantageously, ingredients may also be included to minimize the wrinkling of fabrics that occurs during conventional drying processes. Detergent products incorporating starch as a fabric conditioning agent are disclosed in U.S. Pat. No. 3,892,681, Edwards et al, issued July 1, 1975, and incorporated herein by reference. A non-limiting example of such a fabric conditioning agent is corn starch, which can be added at a level of 0.1–5.0% by weight of the composition, preferably 0.25–1.0%.

Anti-tarnish and anti-corrosion agents, perfume and color (dye or pigment) can also be included, the last ingredient being conveniently added either as a general color or in the form of a speckle applied to a separate granule fraction of the entire formulation or to a granulate of one or more of the ingredients.

The pH of detergent formulations in accordance with the present invention can lie anywhere within the range 5–12 but is preferably chosen to fall within the range 8.0–10.5 as this provides a slight particulate soil removal benefit on synthetic fabrics. However, the use of specific optional components such as enzymes may require the selection of a product pH that will permit optimum functioning of the component concerned.

Composition Usage

As previously stated, the particulate additive products can be conveniently employed to supplement an aqueous liquor containing a conventional laundry detergent composition. Levels of product addition to give from 10 ppm to 250 ppm, preferably from 40 ppm to 100 ppm of antistatic agent in solution are generally used. Where the additive forms part of a combination product providing, for example, presoak capability the formulation will typically comprise about 1% to 30%, preferably 5% to 20% by weight of the particulate antistat additive product, from 10% to 80%, preferably 20% to 60% of a detergency builder, from about 5% to 45%, preferably 10% to 30% by weight of a bleach, and from 0.05% to 2.0%, preferably 0.1% to 1.0% by weight of a detergency enzyme. Compositions of this type are designed to deliver approximately 100–500 ppm builder concentration to a 5–8 gallon soak solution when employed at the ½ to 1½ cup usage level which is common practice in household laundering processes.

Fully formulated detergent compositions, in addition to providing the solution concentration of detergency builder specified above, also provide a surfactant concentration in the range 50–500 ppm, more preferably 150–250 ppm in a 5–8 gallon wash solution. Surfactant level in product will normally range from 1% to 50%, preferably 10% to 25% by weight of the composition.

In use, the detergent additive product may be in contact with the fabrics for 1 to 24 hours if employed as, or as part of, a presoak treatment following which the wash liquor is removed and replaced by fresh water and detergent, and the fabrics are laundered.

When used directly in the laundering operation either as a separate additive product or as part of a fully formulated detergent composition, the solution containing the suspended particulate antistat additive is in contact with the fabrics for 10 to 45 minutes, following which, the fabrics are rinsed and spun dry before being subjected to temperatures of 125° F.–200° F. in a conventional rotary dryer. During the drying process, the particulate antistat product softens as the fabrics approach the dryer air temperature, and the tumbling action of the dryer causes the individual particles of material to "crayon" or smear, thus distributing the quaternary antistat over the surface of the fabrics and minimizing the build-up of static charges on the fabrics.

The following examples illustrate the compositions and processes of the invention, but are not intended to be limiting thereof:

EXAMPLE I

A mixture of ditallow dimethyl ammonium chloride, hereinafter DTDMAC, (tradename Adogen 442-100P) and hydrogenated soya triglyceride, hereinafter "triglyceride", (tradename Neustrene 064) was prepared by melting the two materials together in a weight ratio of 2:3 DTDMAC:triglyceride. This mixture was then solidified by spraying the molten mixture at a temperature of 210° F. into cool air. The resultant solid had a mean particle size of approximately 125 microns and is identified as Composition A.

A similar mixture, but in the weight ratio of 3:1 by weight DTDMAC:triglyceride was prepared in the same manner and is identified as Composition B.

The resultant solids of compositions A and B as well as a mixture of 3:1 by weight DTDMAC:tallow alcohol were placed in 80° F./60% R.H. and 80° F./80% R.H. environments to determine hygroscopicity. The following results were obtained after 48 to 72 hours exposure:

| | % Weight Gain | |
|---|---|---|
| | 80° F./60% RH | 80° F./80% RH |
| Composition A (72 hours)* | 0.16% | 0.95% |
| 3:1 DTDMAC:tallow alcohol (72 hours) | 5.06% | 8.50% |
| Composition B (48 hours)* | −0.70% | 0.64% |
| 3:1 DTDMAC:tallow alcohol (48 hours) | 4.43% | 8.56% |

*Average of two runs

Compositions A and B, after exposure to the humid environments, were free flowing whereas the DTDMAC/tallow alcohol mixture was severely caked.

Compositions A and B are blended with sodium tripolyphosphate at a weight ratio of 7:6 for a total of 13 parts and agglomerated with 4.5 parts dextrin glue solution (35% solid dextrin). The agglomerates are then mixed with 11.5 parts of montmorrillonite clay. The resultant mixture also shows less hygroscopicity and less caking tendency than a similar mixture made with DTDMAC/tallow alcohol in place of DTDMAC/triglyceride.

EXAMPLE II

Example I was repeated using ratios of DTDMAC to triglyceride of 5:1 and 8:1 with the same Composition B as a control. The following results were obtained after 48 hours.

| | % Weight Gain | |
|---|---|---|
| | 80° F./60% RH | 80° F./80% RH |
| 5:1 ratio* | 1.02 | 2.40 |
| 8:1 ratio* | 1.07 | 2.09 |
| 3:1 DTDMAC:tallow alcohol | 4.40 | 7.86 |

*Average of two runs.

As can be seen from the above, the triglycerides are extremely effective in protecting the DTDMAC even at low levels. The prills were also free flowing.

EXAMPLE III

Large prills from the 5:1 ratio product of Example II were separated, frozen with dry ice, ground in an Osterizer, raised to room temperature, and tested for 24 hours in an 80° F./80% RH room against the normal 5:1 ratio product. Essentially equivalent water pick up was found showing that the protective effect is not simply from providing a coating, but rather from the phase change induced by the triglyceride.

The mixture comprising Compositions A and B are incorporated at a level of about 20% in a detergent composition comprising 12% sodium $C_{13}$ alkyl benzene sulfonate, 3% $C_{12-13}$ alkyl polyethoxylate (6.5), 24% sodium tripolyphosphate, 11% sodium silicate (2.4 r), and the balance sodium sulfate and miscellaneous to provide a detergent composition that also softens fabric and provides static control when the fabrics are machine dryed.

What is claimed is:

1. A particulate detergent additive product adapted to prevent static buildup on textiles when applied thereto from a detergent wash liquor, said particulate product being an intimate mixture of:

(a) from about 5% to about 95% by weight of the particles of quaternary ammonium compounds of formula $[R_1R_2R_3R_4N]^+Y^-$, wherein at least one of $R_1R_2R_3$ and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y consituting an anionic radical selected from the group consisting of hydroxide, halide, acetate, sulphate, methylsulfate ions and phosphate ions, and (b) from about 5% to about 95% by weight of the particles of a dispersion inhibitor, being a solid organic material having a maximum solubility in water of 50 ppm max at 25° C. and a softening point in the range of from about 100° F. to about 200° F., and comprising at least about 1% by weight of solid hydrogenated triglycerides of fatty acids having chain lengths of from about 12 to about 22 carbon atoms, substantially all of the individual particles having a size within the range from about 10 microns to about 500 microns, said product having a solubility in water of 50 ppm max at 25° C. and having a softening point in the range of from about 100° F. to about 200° F. and said product being essentially free of hydrogenated castor oil.

2. A particulate detergent additive product according to claim 1 wherein substantially all of the particles have a size within the range of from about 25 microns to about 250 microns.

3. A particulate detergent additive product according to claim 1 wherein substantially all of the particles have a size within the range of from about 50 microns to about 150 microns.

4. A particulate detergent additive product according to claim 1 wherein the particles have a softening point in the range of from about 150° F. to about 175° F.

5. A particulate detergent additive product according to claim 1 wherein the weight ratio of quaternary ammonium compound to dispersion inhibitor lies in the range of from about 1:1 to about 8:1.

6. A particulate detergent additive product according to claim 1 wherein the weight ratio of quaternary ammonium compound to dispersion inhibitor lies in the range of from about 5:1 to about 2:1.

7. A particulate detergent additive product according to claim 2 wherein the intimate mixture is formed of a solidified comelt of the quaternary ammonium compound and the dispersion inhibitor.

8. A particulate detergent additive product according to claim 1 wherein the quaternary ammonium compound is selected from ditallow dimethyl ammonium chloride and ditallow dimethyl ammonium methyl sulfate.

9. A detergent composition adapted to prevent static buildup on textiles laundered therewith consisting essentially of:

(a) from about 5% to about 90% by weight of the composition of a surfactant selected from the group consisting of anionic, nonionic, and zwitterionic surfactants, (b) from about 3% to about 50% by weight of the detergent additive product of claim 1.

10. A detergent composition according to claim 9 wherein substantially of of the detergent additive product particles have a size within the range 25 microns to 250 microns.

11. A detergent composition according to claim 9 wherein the detergent additive product particles have a softening point in the range 150° F. to 175° F.

12. A detergent composition according to claim 9 wherein the detergent additive product has a weight ratio of quaternary ammonium compound to dispersion inhibitor in the range of from about 1:1 to about 8:1.

13. A detergent composition according to claim 9 wherein the detergent additive product is an intimate mixture formed of a solidified comelt of the quaternary ammonium compound and the dispersion inhibitor.

14. A granular detergent additive product consisting essentially of:

(a) from about 5% to about 95% by weight of the detergent additive of claim 1; and (b) from about 95% to about 5% by weight of the product of a detergent adjunct selected from the group consisting of organic and inorganic detergency builders, chlorine and peroxybleach compounds, soil suspending agents, suds modifiers, enzymes, antibacterial agents, and optical brighteners, and mixtures of any of the foregoing.

15. A granular detergent additive product according to claim 14 wherein the detergent adjunct is a detergency builder selected from the group consisting of alkali metal, ammonium and alkanolammonium, polyphosphates, pyrophosphates, bicarbonates, carbonates, silicates, borates, nitrilotriacetates, and citrates.

16. A granular detergent additive product according to claim 14 wherein the detergent adjunct is a detergency builder selected from the group consisting of fully hydrated alkali metal zeolite A, B and X-type materials having a particle diameter from about 0.01 to about 10 microns.

17. A granular additive product according to claim 14 wherein the bleach is selected from the group consisting of sodium perborate, sodium percarbonate, and potassium monopersulfate.

18. A granular detergent additive product according to claim 14 wherein the enzyme is selected from the group consisting of alkaline and neutral proteases and amylases, and mixtures thereof.

19. A granular detergent composition adapted to prevent static buildup on textiles laundered therewith consisting essentially of:

(a) from about 10% to about 25% by weight of the compositions of an anionic surfactant selected from the group consisting of water-soluble $C_{10-13}$ linear and branched alkyl benzene sulfonates, $C_{10-20}$ linear alkyl sulfates, $C_{10-20}$ alkane sulfonates, $C_{10-20}$ olefin sulfonates and mixtures thereof;

(b) from about 10% to about 60% by weight of the composition of a detergent builder salt; and (c) from about 3% to about 25% by weight of the composition of the detergent additive product of claim 1.

20. A granular detergent composition according to claim 19 wherein the detergent builder is present in an amount of from 15% to 45% by weight of the composition.

21. A granular detergent composition according to claim 19 wherein the detergent builder comprises a water soluble salt selected from the group consisting of alkali metal, ammonium and alkanolammonium, polyphosphates, pyrophosphates, bicarbonates, carbonates, silicates, borates, nitrilotriacetates, and citrates.

22. A granular detergent composition according to claim 21 whrein the detergent builder additionally comprises from about 5% to about 25% of a detergent builder is selected from fully hydrated alkali metal zeolite A, B and X-type materials having particle diameters of from about 0.01 to about 10 microns.

23. A granular detergent composition according to claim 19 including from about 5% to about 20% by weight of the composition of a smectite clay selected from the group consisting of alkali metal and calcium montmorillonites, alkali metal saponites and hectorites, and mixtures thereof.

24. A granular detergent composition according to claim 19 including 0.1% to 5% of a fabric conditioning agent serving to reduce wrinkling.

* * * * *